US011486180B2

(12) United States Patent
Capur et al.

(10) Patent No.: US 11,486,180 B2
(45) Date of Patent: Nov. 1, 2022

(54) FURNITURE HINGE

(71) Applicant: Samet Kalip Ve Maden Esya San. Ve Tic. A.S., Istanbul (TR)

(72) Inventors: Ertac Capur, Istanbul (TR); Ufuk Kiziltan, Istanbul (TR); Himmet Tanriverdi, Istanbul (TR)

(73) Assignee: Atatürk Mah. Adnan Menderes Cad. No: 8/13, Esenyurt (TR)

( * ) Notice: Subject to any disclaimer, the term of this patent is extended or adjusted under 35 U.S.C. 154(b) by 0 days.

(21) Appl. No.: 17/254,467

(22) PCT Filed: Jul. 5, 2018

(86) PCT No.: PCT/TR2018/050346

§ 371 (c)(1),
(2) Date: Dec. 21, 2020

(87) PCT Pub. No.: WO2020/009671

PCT Pub. Date: Jan. 9, 2020

(65) Prior Publication Data

US 2021/0148150 A1 May 20, 2021

(51) Int. Cl.
*E05F 1/08* (2006.01)
*E05F 5/00* (2017.01)

(52) U.S. Cl.
CPC ..... *E05F 5/006* (2013.01); *E05Y 2201/25* (2013.01); *E05Y 2600/12* (2013.01); *E05Y 2600/32* (2013.01); *E05Y 2900/20* (2013.01)

(58) Field of Classification Search
CPC ..... E05Y 2900/20; E05Y 2900/202; E05Y 2900/204; E05Y 2900/208; E05Y 2201/20;

(Continued)

(56) References Cited

U.S. PATENT DOCUMENTS 7,552,509 B2 * 6/2009 Chen ..... E05F 5/10 16/50
8,307,498 B2 * 11/2012 Krammer ..... E05F 5/04 16/83

(Continued)

FOREIGN PATENT DOCUMENTS

CN 103590692 A 2/2014
CN 103711393 A 4/2014

(Continued)

OTHER PUBLICATIONS

Office Action for corresponding China 2022012602557340 dated Jan. 29, 2022, 7 pages (not prior art).

(Continued)

*Primary Examiner* — Chuck Y Mah
(74) *Attorney, Agent, or Firm* — Lucian Wayne Beavers; Patterson Intellectual Property Law, PC

(57) ABSTRACT

The invention relates to a furniture hinge comprising a stop element (20) and a joint part (30) connected to the stop element (20) via a joint lever (27), the joint part (30) supporting a damper (60), for applying a damping effect between the stop element (20) and the joint part (30), a locking element (43) being adjustable between a release position and a locking position by means of an operating element (41) of an actuating unit (40), and the locking element (43) locking the damper (60) in an at least partially compressed damping position. For improved operating reliability, it is provided according to the invention for the locking element (43) to be adjustable relative to the operating element (41) by means of at least one actuator (41.7) and at least one actuator receiving portion (43.3).

20 Claims, 6 Drawing Sheets

(58) Field of Classification Search

CPC ..... E05Y 2201/21; E05Y 2201/261; E05Y 2201/11; E05Y 2201/258; E05Y 2201/46; E05Y 2201/474; E05F 5/006; E05F 5/02; E05F 5/027; E05D 11/0054; E05D 11/1021; E05D 11/1042; E05D 11/105; E05D 11/1064; E05D 7/04; E05D 7/0407; E05D 7/123; E05D 7/125; E05D 3/142; Y10T 16/5383; Y10T 16/304; Y10T 16/54029

See application file for complete search history.

(56) References Cited

U.S. PATENT DOCUMENTS

| | | | | |
|---|---|---|---|---|
| 8,650,711 | B1 * | 2/2014 | Chen | E05F 5/006 16/296 |
| 9,366,067 | B2 * | 6/2016 | Wu | E05F 1/1215 |
| 9,611,682 | B2 | 4/2017 | Forster et al. | |
| 9,874,049 | B1 * | 1/2018 | McGregor | E05D 5/065 |
| 10,260,267 | B2 | 4/2019 | Kirenci et al. | |
| 10,280,671 | B2 | 5/2019 | Kirenci et al. | |
| 2011/0005032 | A1 * | 1/2011 | Domenig | E05F 5/006 16/50 |
| 2013/0160242 | A1 * | 6/2013 | Brunnmayr | E05F 5/02 16/85 |
| 2014/0345081 | A1 * | 11/2014 | Salice | E05F 5/006 16/50 |
| 2015/0068126 | A1 | 3/2015 | Forster et al. | |
| 2016/0032636 | A1 | 2/2016 | Dai | |
| 2017/0107749 | A1 * | 4/2017 | McGregor | E05F 5/006 |
| 2017/0370139 | A1 * | 12/2017 | McGregor | E05D 7/0009 |
| 2018/0328093 | A1 * | 11/2018 | Zimmer | E05F 5/02 |
| 2018/0355651 | A1 * | 12/2018 | Liang | E05D 11/1021 |

FOREIGN PATENT DOCUMENTS

| | | | | |
|---|---|---|---|---|
| CN | 203684869 | U | 7/2014 | |
| CN | 104179408 | A | 12/2014 | |
| CN | 106121427 | A | 11/2016 | |
| CN | 106193866 | A | 12/2016 | |
| DE | 202005011752 | U1 | 1/2007 | |
| DE | 202012003508 | U1 | 8/2013 | |
| DE | 102015106917 | A1 | 11/2016 | |
| EP | 2278104 | A1 | 1/2011 | |
| WO | 2007009899 | A1 | 1/2007 | |
| WO | 2013149632 | A1 | 10/2013 | |
| WO | WO-2013149632 | A1 * | 10/2013 | E05D 11/06 |

OTHER PUBLICATIONS

International Search Report for corresponding PCT/TR2018/050346, dated Jul. 31, 2019, 11 pages (not prior art).

* cited by examiner

FURNITURE HINGE

The invention relates to a furniture hinge comprising a stop element and a joint part connected to the stop element via a joint lever, the joint part supporting a damper for applying a damping effect between the stop element and the joint part, a locking element being adjustable between a release position and a locking position by means of an operating element, and the locking element, in the locking position, locking the damper in an at least partially compressed damping position.

A furniture hinge of this type is known from DE 10 2015 106 917 A1. For this hinge, a joint part is coupled to a stop element via a joint lever. The joint part comprises a hinge cup. Said hinge cup can be fastened in a cup receiving portion of a cupboard door. The stop element can be fixed to a furniture body. A damper is mounted on the hinge cup, which damper is operative between the joint part and the stop element and acts on the joint lever. When the hinge is closed, the joint lever comes into operative connection with the damper. The damper then damps the closing movement of the hinge. As a result, the cupboard door is prevented from slamming on the furniture body. In addition, a spring is provided on the hinge, which spring produces a closing force between the joint part and the stop element. The cupboard door is then drawn into the closed position by means of the spring against the damping effect of the damper. For large doors, more than two hinges are used in most cases. Depending on the weight of the door, the overall damping effect of all the dampers may be greater than desired. In this case, the damper can be locked in the compressed damping position on some of the hinges by means of an actuating unit. There can thus be no or only a small damping effect while the hinge is closing. The actuating unit comprises a rotatable fastening stud on which an actuating portion comprising a stop is integrally formed. As a result of a rotation of the adjusting knob, the stop can be associated with a counter stop of the damper in order to achieve the locking position.

Another furniture hinge is known from CN 106193866 A. In this case, the damping effect can be adjusted by means of an adjusting screw. If the furniture in which a furniture hinge of this kind is built is subjected to vibrations, the adjusting screw may be unintentionally displaced and thus the damping effect may be altered. If there are particles of dirt on the threads after a long time in operation, the coefficient of friction in the threaded connection changes and the adjusting screw can work loose from the adjusted position, in particular in the event of vibrations.

Another furniture hinge in which the damper can be locked is known from WO 2013/149632 A1.

The problem addressed by the invention is that of producing a furniture hinge which is simple to operate and in which the damper can be reliably locked in a compressed damping position.

This problem is solved by the locking element being adjustable relative to the operating element by means of at least one actuator and at least one actuator receiving portion.

According to the invention, two components, namely the operating element and the locking element, that are adjustable with respect to each other are thus used. Reliable locking can be achieved by means of this structural separation. The locking element can be pushed into the blocking state by means of the operating element. In the process, the actuator can be associated with the actuator receiving portion such that secure blocking is achieved that is not released even in the event of vibrations.

According to a preferred design variant of the invention, the actuator and the actuator receiving portion are part of an actuating mechanism in which the actuator and the locking element form mechanism parts. The movement of the operating element can be transferred into the movement of the locking element by means of the actuating mechanism. As the actuating mechanism, an eccentric mechanism, a lever mechanism or a toothed-gear mechanism can be used, for example. Other types of mechanisms are also conceivable. In this case, an eccentric mechanism has in particular the advantage of a simple construction and provides reliable operation. Depending on the desired design, the actuating mechanism has the advantage that the required force for operating the operating element is selectable. This then leads to comfortable operation of the operating element.

The design of an eccentric mechanism, the actuator can in particular form an eccentric which is eccentrically adjustable about an axis of rotation or about an arc path and the actuator receiving portion receives the actuator.

This then results in a simple design if the operating element, at a base part, comprises a top part having a tool receiving portion.

For clear user guidance, the operating element can be rotatably mounted and adjustable between at least two latching positions.

In a conceivable alternative of the invention, the operating element is mounted on a support, in particular rotatably mounted, and/or the support bears the locking element in an adjustable manner, in particular in a linearly adjustable manner in a linear guide or in a substantially linearly adjustable manner. The operating element or the locking element can be guided on the support in a precisely fitting manner. The support can then be connected to the joint part. It is particularly advantageous if both the operating element and the locking element can be mounted on the support, so as to result in a single actuating unit. Said actuating unit can be preassembled and then connected to the joint part.

In a possible variant of the invention, the support, at a base part, supports one or more positioning members and the operating element comprises at least one positioning element, the positioning member and the positioning element being adjustable so as to be resilient with respect to one another, in order to form latching positions when the positioning member engages in the positioning element. In this manner, clear user guidance can be achieved. The latching positions can indicate to a user whether the locking element is set in the open position or in the locking position, for example. In addition, the operating element is clearly positioned and secured in the latching positions. The operating element and/or the positioning element can be formed, for example, as plastics injection-molded parts, such that the springiness between the positioning member and the positioning element can be simply achieved.

According to a particularly preferred variant of the invention, the operating element may comprise the latching element in the form of a latching elevation which engages in a receiving portion in the support in order to form the latching connection and the rotational mounting between the operating element and the support. As a result, fewer parts are required and the assembly effort required is smaller. For this purpose, the support may comprise, between two retaining lugs, a receiving region for the locking element, and the two or one of the two retaining lugs may form a linear guide for the locking element.

A furniture hinge according to the invention may also be such that the locking element comprises a bolt which, in the locking position of the locking element, rests against a detent member of the damper in order to form an effective interlocking connection in the damping direction, and such that the bolt and/or the detent member are resilient or resiliently retained. This results in high operating reliability. If the damper is in its extended position, for example, the locking element can be brought into the closed position. In this case, the bolt of the locking element does not yet rest on the detent member of the damper in the provided position. The hinge can now be closed, the damper being moved into its retracted, compressed position. During this movement, the bolt and the detent member meet. Owing to the springiness, the two parts give way to each other and the damper can be moved into its compressed damping position. Once the bolt and the detent member have moved past each other during this movement, the springiness causes a return movement. The bolt then locks the detent member in an interlocking manner such that the damper is secured. Of course, the damper can also be moved first into the compressed damping position. The operating element is then operated and the locking element is moved into the locking position.

According to one variant of the invention, the operating element and the locking element can be parts of a preassembled modular unit which are connected, in particular latched, to the joint part.

The invention is explained in greater detail in the following on the basis of an embodiment shown in the drawings, in which.

Figure 1:
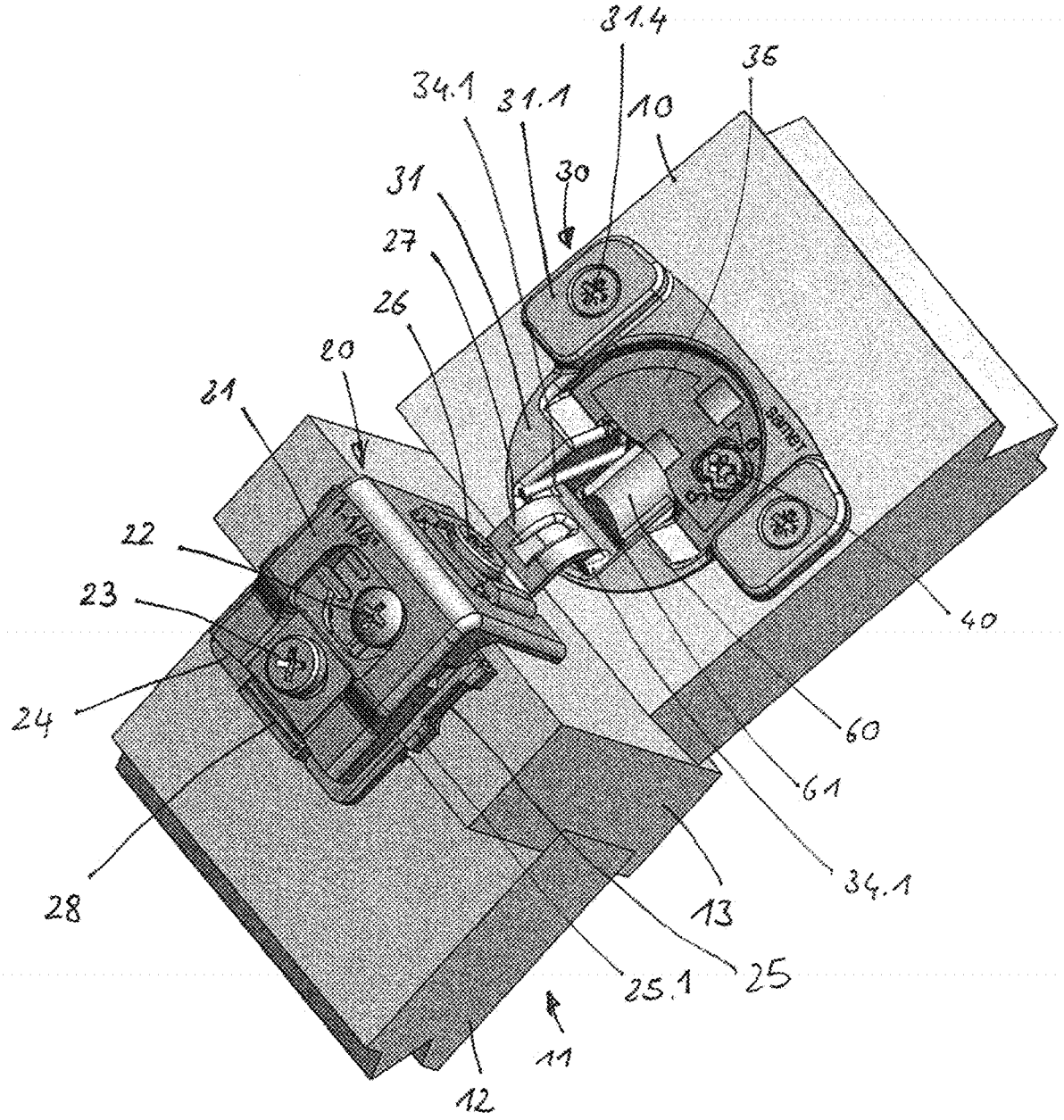
FIG. 1 is a perspective view of a part of a piece of furniture and a hinge.

FIG. 1 shows a portion of a piece of furniture comprising a furniture body 11, which comprises a side wall 12 and a front wall 13. The front wall 13 forms an opening through which the interior of the furniture body 11 can be accessed. A furniture hinge is retained in the region of the front wall 13. The furniture hinge is used to couple a door 10 to the furniture body 11 in an articulated manner.

Figure 2:
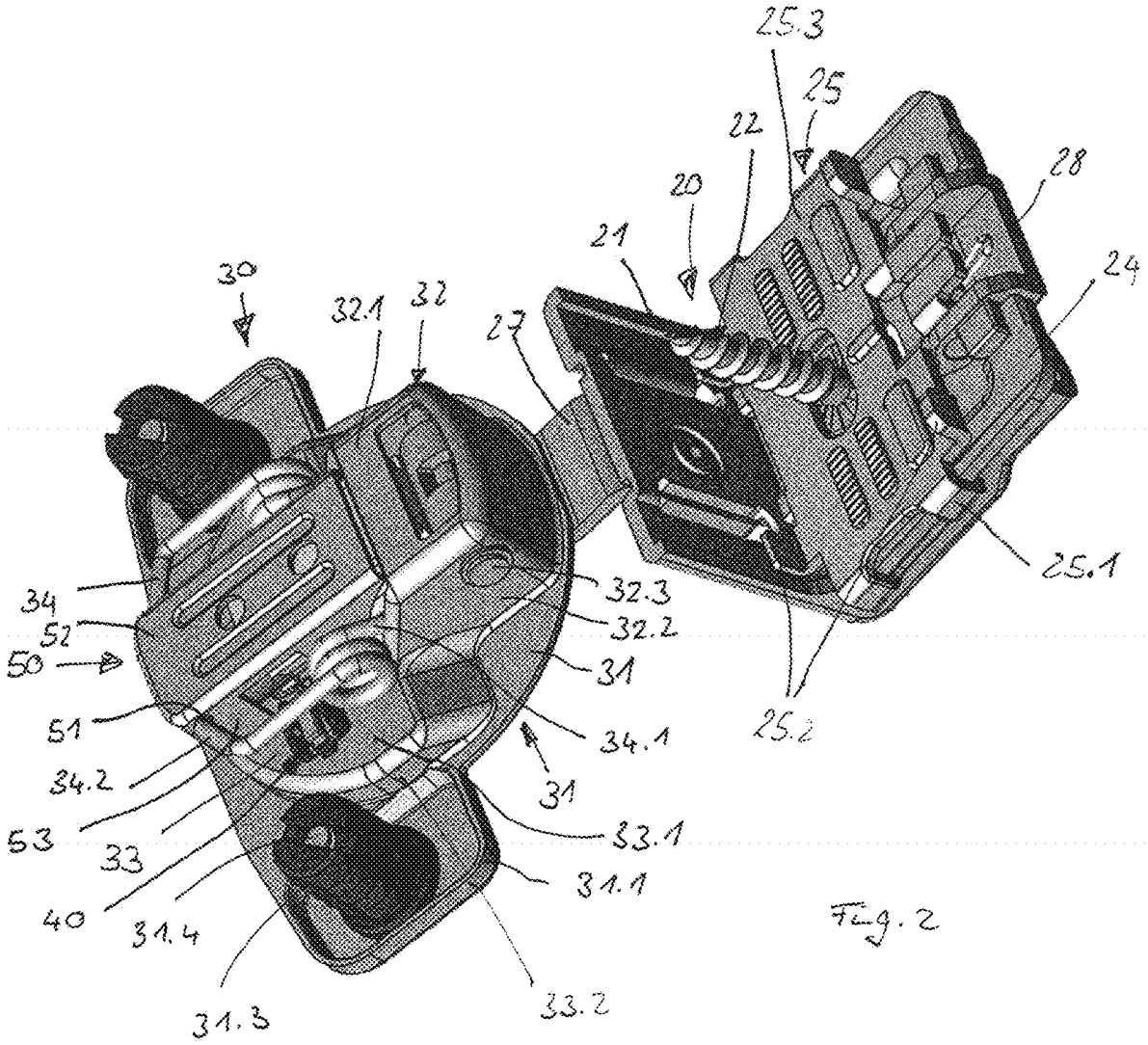
FIG. 2 is a perspective rear view of the hinge according to FIG. 1.

As shown in FIGS. 1 and 2, the furniture hinge has a stop element 20. Said stop element 20 comprises a retainer 21. The retainer 21 can be releasably connected to a mounting element 25. The mounting element 25 can be screwed to the furniture body, in particular to the front wall 13, by means of a fastening screw 22. In order to precisely align the mounting element 25, centering elements 25.2 are provided. Said centering elements 25.2 are bent from a mounting plate 25.3 of the mounting element 25. Opposite the centering elements 25.5, the mounting plate 25.3 comprises, on its top, guides 25.1. Said guides 25.1 are formed as tabs in the shape of a U and are used to receive the retainer 21. For this purpose, the retainer 21 comprises, on the side in the region of the guides 25.1, edges around which the guides 25.1 extend in order to form longitudinal guides. In the position shown in FIG. 2, the mounting element 25 can be releasably coupled to the retainer 21 via a latch 28. The latch 28 is mounted on the retainer 21 around a pivot axis extending in parallel with the hinge axis. A latching flank of said latch engages behind a rear latching edge of the mounting plate 25.3, as can be seen in FIG. 2. As shown in FIG. 1, one or more adjusting screws 23 can be provided in the region of the stop part 20. By means of said adjusting screws 23, the alignment of the retainer 21 with respect to the mounting element 25 can be corrected.

The retainer 21 also has a receiving portion for a joint lever 27. The joint lever 27 is connected to the retainer 21 by means of a fastening element 26. The joint lever 27 connects the stop element 20 to a joint part 30.

Figure 3:
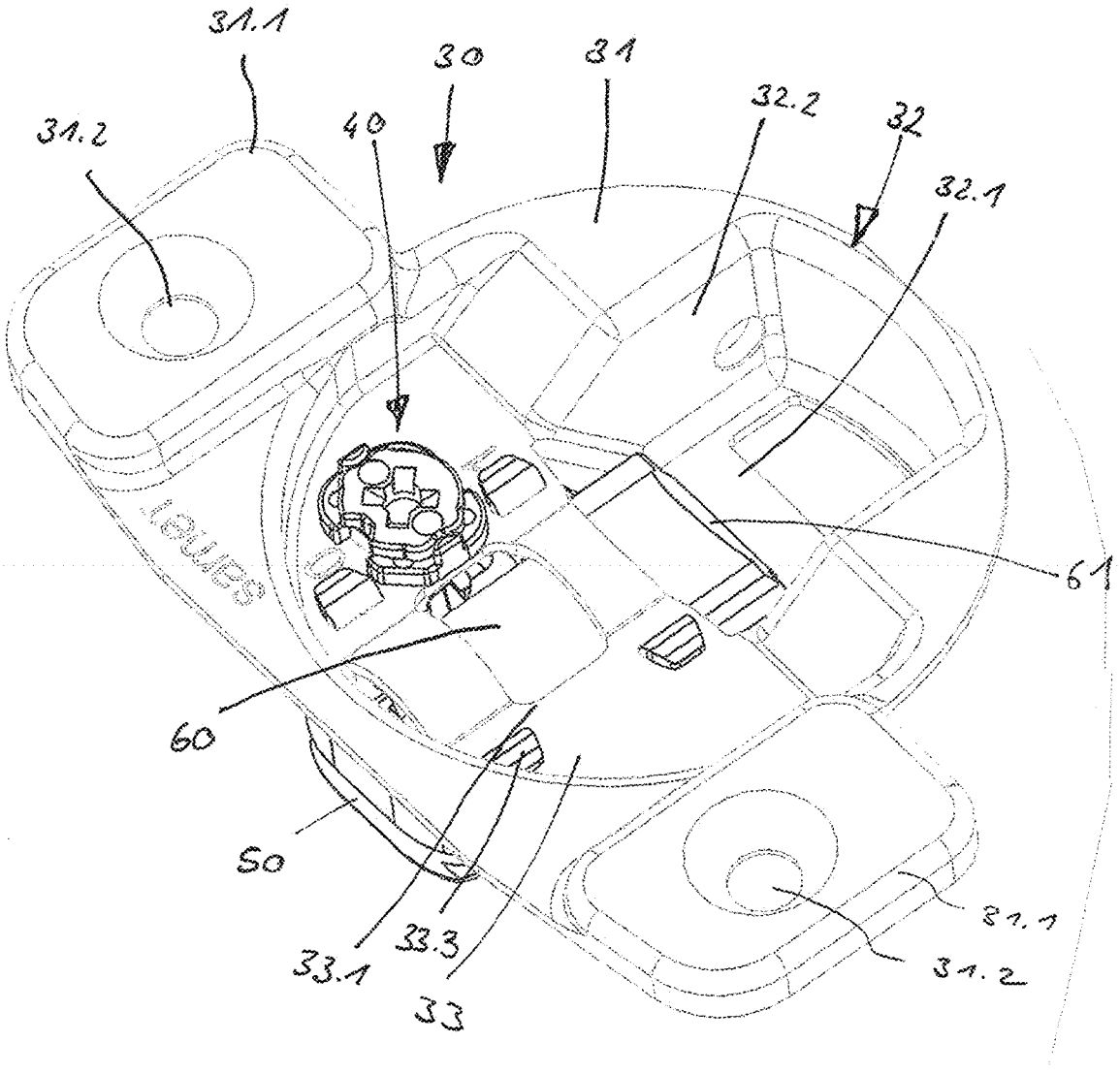
FIG. 3 is a perspective front view of a joint part of the hinge according to FIGS. 1 and 2.

The design of the joint part 30 is first explained in greater detail with reference to FIGS. 3 and 4. As shown in these drawings, the joint part 30 comprises a hinge cup 32. The hinge cup 32 is surmounted at the front at least in part by a stop 31. The joint part 30 is inserted in a known manner together with the hinge cup 32 into a cup receiving portion in the door 10 or the furniture body 11. The situation in which said part is mounted on a door 10 is shown in FIG. 1. The movement of inserting the joint part 30 into the cup receiving portion is delimited by the stop 31. This strikes the top of the door 10. Fastening tabs 31.1 comprising screw receiving portions 31.2 are provided at the sides of the joint part 30. Fastening screws 31.4 can be guided through the screw receiving portions 31.2 and screwed into screw anchors 31.3. The screw anchors are secured in perforations in the furniture and expanded therein by means of the fastening screws 31.4.

As shown in these drawings, the joint part 30 comprises a hinge cup 32. The hinge cup 32 has a base 32.1 to which side walls 32.2 are directly or indirectly connected. According to FIG. 2, the hinge cup 32 comprises a pivot bolt 32.3 which passes through mutually aligned holes in opposite side walls 32.2. The pivot bolt 32.3 is used to receive the joint lever 27 in an articulated manner. For this purpose, the joint lever 27 consists of one sheet metal part which is curled up at the end in order to form a gudgeon through which the pivot bolt 32.3 is placed.

A cup element 33 is attached to the hinge cup 32. The cup element 33 forms a base 33.1. The base 33.1 is offset to the base 32.1 in the depth direction, as can be seen clearly in FIG. 4. Side walls 33.2 can also be attached to the base 33.1, which side walls transition into the stop 31. The base 33.1 comprises latch receiving portions 33.3. A panel 35 can be latched into the latch receiving portions 33.3. The panel 35 is shown in FIG. 1.

According to the views in FIGS. 1 and 2, a spring 34 can be coupled to the joint part 30. The spring 34 comprises a connecting portion 34.2 from which two spring legs 34.1 branch off. The spring legs 34.1 are supported on the joint lever 27, as shown in FIG. 1. The spring 34 is also secured to a spring receiving portion 51 on the joint part 30 by means of the connecting portion 34.2. The spring receiving portion 51 can be part of a casing 50, for example, which is fastened to the joint part 30. The casing 50 can be seen in FIG. 2. As shown in this drawing, the casing 50 comprises a base 52. Side walls 53 are attached to the base 52. The side walls 53 may for example support latching elements, by means of which the casing 50 is latched to the joint part 30.

Figure 4:
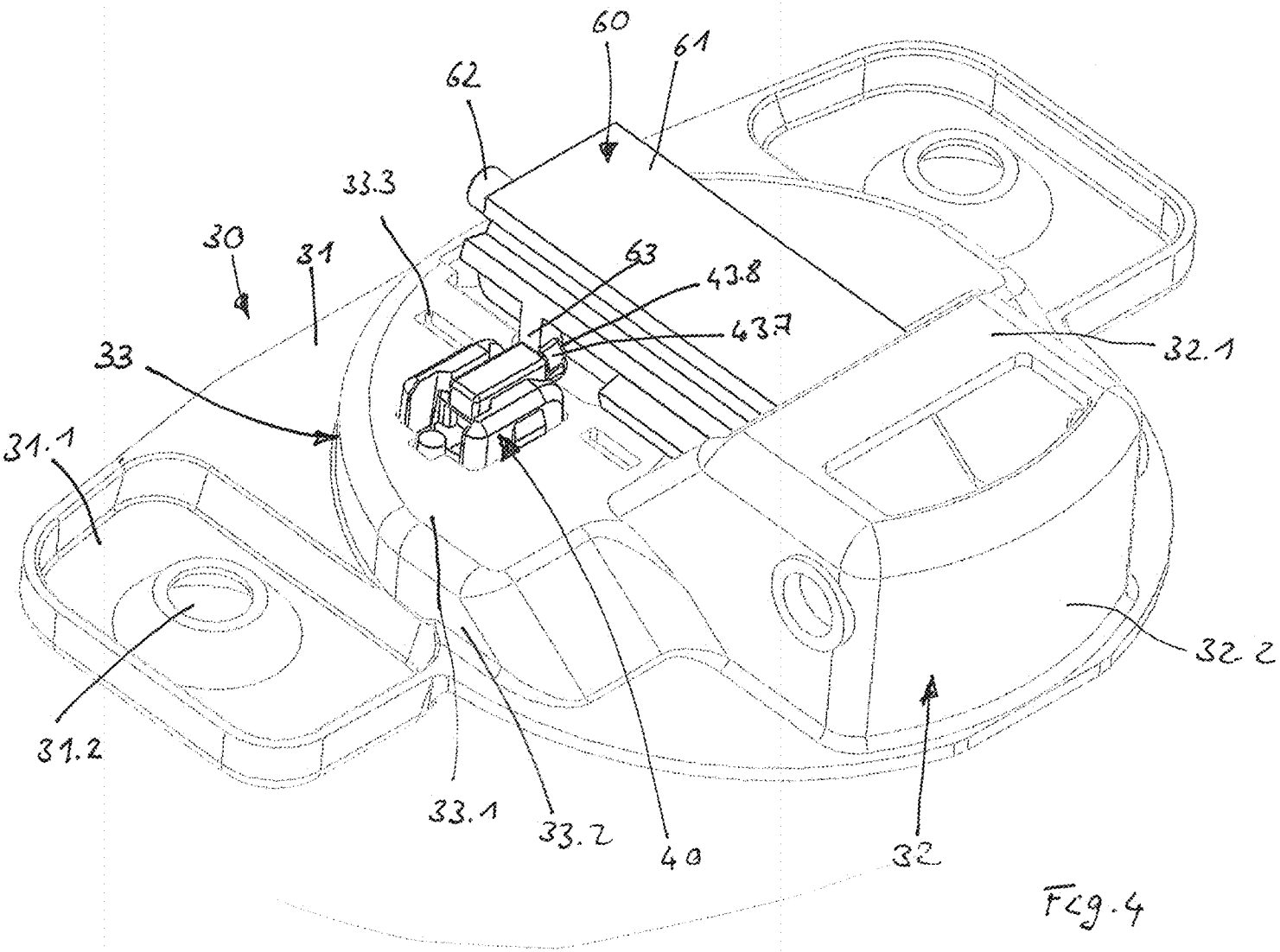
FIG. 4 is a perspective rear view of the joint part according to FIG. 3.

According to FIG. 4, a damper 60 is fastened to the joint part 30. The damper 60 may be designed as a linear damper, in particular as a linear fluid damper, preferably as an air damper, or a liquid damper, for example an oil damper. In the present embodiment, the damper 60 comprises a cylinder. A piston is linearly adjustable in the cylinder. A piston rod 62 is coupled to the piston. In the drawings (see in particular FIG. 3), the cylinder of the damper 60 is provided with an inclined surface 61. It is conceivable that the component which is shown in the drawings and is provided with the inclined surface 61 does not form the cylinder of the damper 60, but rather said component can be formed in the manner of a casing and can receive the damper together with the damping cylinder and the piston in a receiving portion.

The damper 60 is connected to the base 33.1 of the cup element 33. In this case, the damper 60 is arranged such that it can be linearly adjusted in a linear guide of the casing part. The piston rod 62 of the damper is supported at the end in a receiving portion of the casing 50. The cylinder of the damper 60 can be shifted in the direction of the longitudinal axis of the piston rod 62 by means of the linear guide of the joint part 30. It is conceivable for example for a linear guide for the damper 60 to be provided in the casing 50. However, it is also conceivable for linear guide elements for the damper 60 to be provided on the cup element 33. If a force is applied to the inclined surface 61 in the direction of the longitudinal extension of the piston rod 62, the cylinder of the damper 60 can be linearly adjusted in the longitudinal guides. Since the piston rod 62 is supported on the casing 50, during this adjustment the piston retracts into the cylinder of the damper 60 in the damping position, as a result of which a damping effect is produced.

An actuating unit 40 can be connected to the joint part 30. The actuating unit 40 comprises an operating element 41. The operating element 41 has a base part 41.2 on which a top part 41.1 is integrally formed. A tool receiving portion 41.4 is formed in the top part 41.1, for example in the form of a slot-shaped receiving portion for a screwdriver. In addition, positioning elements 41.6 are formed on the operating element 41, preferably on opposite sides. The operating element 41 has an indentation 41.5 in the side.

The base part 41.2 can also comprise a latching element 41.3. This latching element 41.3 is shaped in the form of a latching elevation.

The operating element 41 can be connected to a support 42. The support 42 has a base part 42.1 through which a receiving portion 42.3 passes. Counter latching elements 42.4 are arranged in the region of the receiving portion 42.3.

On its top, the base part 42.1 comprises positioning members 42.2. These positioning members 42.2 are matched in terms of their arrangement and geometric shape to the positioning elements 41.6 of the operating element 41, as explained below.

The support 42 comprises two mutually spaced retaining lugs 42.5. A receiving portion in the form of a linear guide is formed between the retaining lugs 42.5. Latching parts 42.6 protrude from the outside of the retaining lugs 42.5. Latching elements 42.8 are integrally formed on the inside of the retaining lugs 42.5 (see FIG. 6). In the region of its rear side, the support 42 has a stop 42.7 which is arranged in the region between the retaining lugs 42.5.

Figure 5:
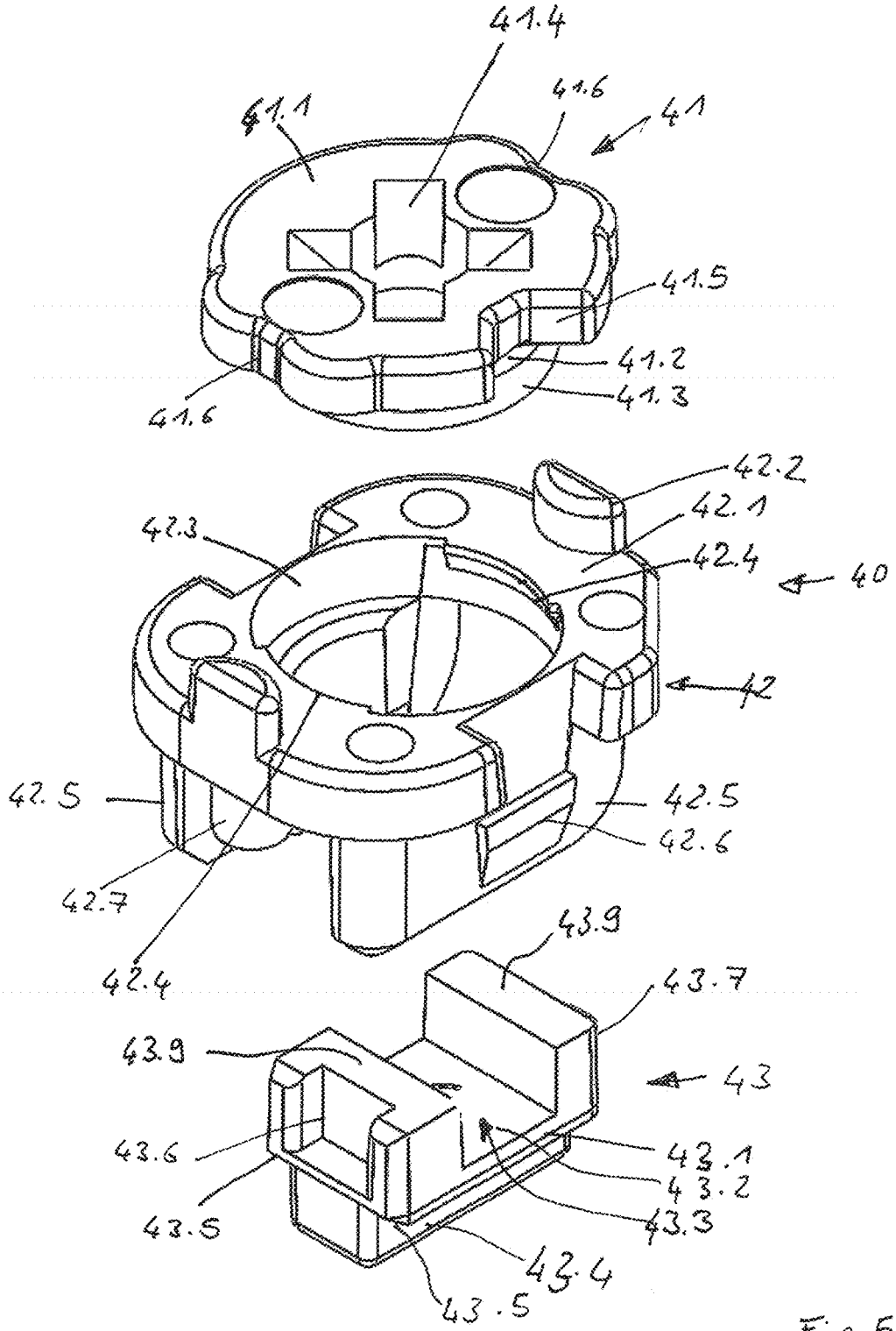
FIG. 5 is an exploded view of an actuating unit of the hinge according to FIGS. 1 to 4.

A locking element 43 can be connected to the support 42. The locking element 43 has a base body 43.1 which comprises a lug 43.4 in the region of its bottom. The lug 43.4 is integrally formed thereon so as to be laterally recessed with respect to the base body 43.1. Lateral guide regions 43.5 are produced in this manner. As can be seen in FIG. 5, the base body 43.1 has an actuator receiving portion 43.3 comprising a base surface 43.2. The actuator receiving portion 43.3 is delimited on opposite sides by two body regions 43.9. A stop 43.6 is provided on the rear side of the locking element 43 in order to delimit the actuating movement of the locking element 43 on the stop 42.7 of the support 42. In the present embodiment, the actuator receiving portion 43.3 is designed as a longitudinal through-slot. Other forms of the actuator receiving portion 43.3 are of course conceivable.

Figure 6:
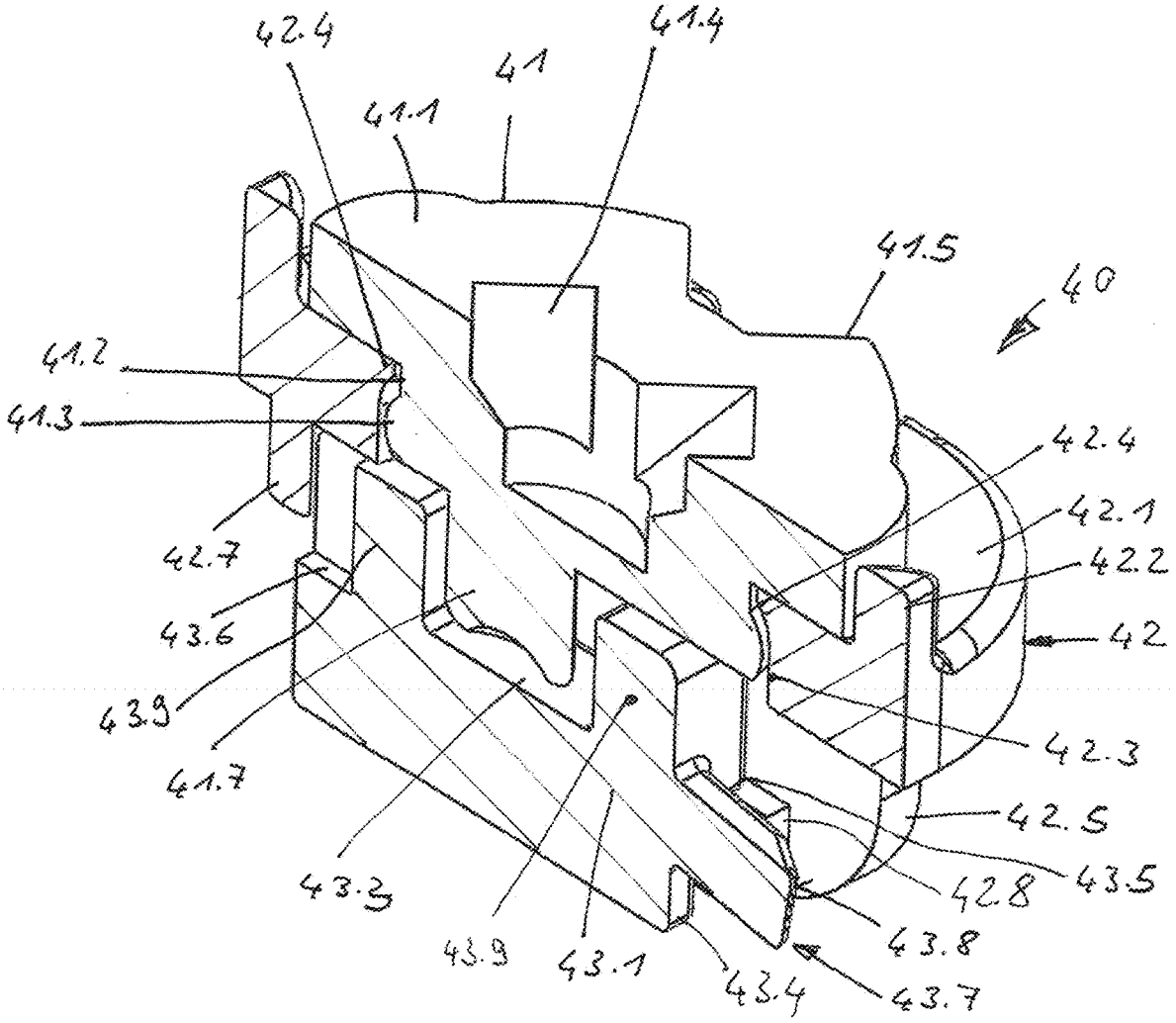
FIG. 6 shows the actuating unit according to FIG. 5 in vertical cross section.

As can be seen in FIG. 6, the locking element 43 has a bolt 43.7. Said bolt can be integrally connected to the locking element 43. Either the bolt 43.7 itself can be resilient and/or the bolt 43.7 can be resiliently coupled to the base body 43.1. The bolt 43.7 comprises an inclined deflection surface 43.8.

In order to mount the actuating unit 40, first the locking element 43 is pushed between the two retaining lugs 42.5 of the support 42. In this case, the guide regions 43.5 of the locking element 43 are arranged such that they are opposite the guide elements 42.8 of the support 42. The side surfaces of the base body 43.1 are guided on the inner sides of the retaining lugs 42.5. As can be seen in FIG. 6, the guide elements 42.8 can form latching elements. In that case, they comprise inclined deflection surfaces. The locking element 43 can be pushed between the retaining lugs 42.5 from the bottom of the support 42. The guide elements 42.8 then resiliently give way with respect to the base body 43.1 of the locking element and, in the mounting position, latch into the guide regions 43.5.

When the locking element 43 has been inserted into the support 42, the operating element 41 can be connected to the support 42 from the top. For this purpose, the latching element 41.3 of the operating element 41 latches with the counter latching element 42.4 of the support 42, resulting in the arrangement shown in FIG. 6. In this case, the latching element 41.3 forms, together with the receiving portion 42.3, a rotational mounting about a vertical axis of rotation. The bottom of the top part 41.1 of the operating element 41 slides on the top of the base part 42.1.

As can be seen in FIG. 6, the operating element 41 has an actuator 41.7. Said actuator is arranged on the operating element 41 eccentrically to the axis of rotation of the operating element 41. The actuator 41.7 is inserted into the actuator receiving portion 43.3 of the locking element 43. By means of the actuator 41.7 engaging in the actuator receiving portion 43.3, the locking element 43 is retained on the support 42 in a captive but linearly adjustable manner.

The operating element 41 is used to adjust the locking element 43. In the position shown in FIG. 6, the operating element 41 is retained in alignment with the positioning member 42.2. The positioning members 42.2 engage in the opposite positioning elements 41.6 of the support 42. Owing to the resilience of the positioning members 42.2 and/or the positioning elements 41.6, a latched arrangement between the positioning members 42.2 and the positioning elements 41.6 is provided here, so as to favor a clear user guidance. As can be seen in FIG. 6, the actuator 41.7 of the operating element 41 rests on the rear body region 43.9 associated with the stop 43.6. The locking element 43 is in a retracted release position. In order to adjust the locking element 43, the operating element 41 can be rotated, for example by means of a screwdriver. The screwdriver can be inserted into the tool receiving portion 41.4. The operating element 41 can then rotate about the axis of rotation thereof. During this rotation, the actuator 41.7 is eccentrically adjusted in the actuator receiving portion 43.3. After a particular angle of rotation, the actuator 41.7 comes into contact with the second base body 43.9. As a result, the locking element 43 is moved by means of the actuator 41.7 from its release position shown in FIG. 6 into a locking position. The rotational movement can be carried out until the positioning members 42.2 snap back into the positioning elements 41.6. The operating element 41 has thus been rotated by 180°. It does not matter whether the rotation is carried out clockwise or counterclockwise. As can be seen in FIG. 6, in the release position, the indentation 41.5 is arranged on one side of the support 42. In the position in which the operating element has been rotated by 180°, the indentation 41.5 is arranged on the other side. The rotated positions can be identified by the indentation 41.5. An indentation can correspondingly be made in the top of the base 32.1 of the hinge cup 32 or on the panel 35 (see for example FIG. 1 or FIG. 3).

The actuating unit 40 consisting of the operating element 41, support 42 and locking element 43 can be connected to the joint part 30. For this purpose, there can be a receiving portion in the base 33.1 of the cup element 33. Said receiving portion may be in the form of an aperture through the base 33.1, for example.

The actuating unit 40 can be mounted in the aperture by means of the support 42. For this purpose, the two retaining lugs 42.5 are inserted into the aperture. The outer latching parts 42.6 of the retaining lugs 42.5 latch into counter elements of the base 33.1. The movement of inserting the support 42 into the aperture is delimited by the bottom of the base part 42.1, which strikes the top of the base 33.1.

As can be seen in FIG. 4, the damper 60 comprises a detent member 63 auf. In the compressed or partially compressed state of the damper 60 (as shown in FIG. 4), the bolt 43.7 interlockingly engages behind the detent member 63, specifically in the direction of the longitudinal axis of the piston rod 62. Owing to this arrangement, the damper 60 can be brought into its compressed or partially-compressed damping position. The operating element 41 can then be rotated, as described above, and the locking element 43 is brought into its extended and locking position (shown in FIG. 4). The bolt 43.7 thus engages behind the detent member 63. However, it is now also conceivable for the damper 60 to be in its extended position, which is shown in FIG. 1, for example. In this position, the operating element 41 can also be rotated and the locking element 43 brought into its locking position. If the damper 60 is now compressed, for example by means of a closing movement of the hinge, then the detent member 63 hits against the inclined deflection surfaces 43.8 of the bolt 43.7. Since the bolt 43.7 and/or the detent member 63 are resilient, the two parts can give way to each other. The detent member 63 can thus be moved past the bolt 43.7 until it engages therebehind. Owing to the springiness, the components snap back and the arrangement shown in FIG. 4 is achieved, in which the detent member 63 is interlockingly locked.

The blocking of the damper 60 can be simply released by the operating element being turned again by 180° and the locking element 43 being moved back into the position shown in FIG. 6. The damper 60 can then be moved back into its position shown in FIG. 1, which can be achieved by means of a compression spring arranged in the damper 60, for example.

The invention claimed is:

1. A furniture hinge, comprising:

a stop element;

a joint part connected to the stop element by a joint lever;

a linear fluid damper supported by the joint part and configured to apply a damping effect between the stop element and the joint part as the damper is linearly compressed during a closing motion of the joint part relative to the stop element;

a locking element adjustable between a release position and a locking position, wherein in the locking position the locking element locks the damper in an at least partially linearly compressed damping position, and wherein in the release position the damper is free to move linearly relative to the locking element; and an operating element connected to the locking element by at least one actuator and at least one actuator receiving portion, the at least one actuator and at least one actuator receiving portion being configured to move the locking element between the release position and the locking position.

2. The furniture hinge of claim 1, wherein:

the actuator and the actuator receiving portion are part of an actuating mechanism in which the operating element and the locking element form mechanism parts.

3. The furniture hinge of claim 1, wherein:

the actuator forms an eccentric which is eccentrically adjustable about an axis of rotation or about an arc path; and the actuator receiving portion receives the actuator.

4. The furniture hinge of claim 1, wherein:

the operating element includes a base part and a top part, the top part having a tool receiving portion.

5. The furniture hinge of claim 1, wherein:

the operating element is rotatably mounted and is adjustable between at least two latching positions.

6. The furniture hinge of claim 1, further comprising:

a support including a linear guide, the locking element being received in the linear guide such that the locking element is linearly adjustable relative to the support; and wherein the operating element is rotatably mounted on the support.

7. The furniture hinge of claim 6, wherein:

the support includes a base part including at least one positioning member; and the operating element includes at least one positioning element, the at least one positioning member and the at least one positioning element being resilient with respect to one another to form at least one latching position when the at least one positioning element engages the at least one positioning member.

8. The furniture hinge of claim 6, wherein:

the operating element includes at least one latching element; and the support includes at least one counter latching element which interacts with the at least one latching element to form at least one latching connection.

9. The furniture hinge of claim 8, wherein:

the at least one latching element of the operating element includes a latching elevation; and the at least one counter latching element of the support includes a receiving portion receiving the latching elevation when the operating element is rotated relative to the support.

10. The furniture hinge of claim 6, wherein:

the support includes two retaining lugs defining a receiving region between the two retaining lugs, the receiving region forming the linear guide for the locking element.

11. The furniture hinge of claim 1, wherein:

the damper includes a detent member; and the locking element includes a bolt configured to rest against the detent member in the locking position of the locking element so as to form an interlocking connection in a damping direction such that at least one of the bolt and the detent member are resiliently retained.

12. The furniture hinge of claim 1, wherein:

the operating element and the locking element are latched to the joint part as parts of a preassembled modular unit.

13. The furniture hinge of claim 1, wherein:

the joint part includes a hinge cup, the damper being at least in part received in the hinge cup.

14. A furniture hinge, comprising:

a first hinge part;

a second hinge part;

a joint lever attached to the second hinge part and pivotally connected to the first hinge part;

a linear fluid damper supported by the first hinge part and configured to apply a damping effect between the first and second hinge parts as the damper is linearly compressed upon engagement of the damper by the joint lever during a closing motion of the first hinge part relative to the second hinge part;

a support mounted on the first hinge part, the support defining a linear guide, the support including a receiving opening;

a locking element received in the linear guide and movable between a release position and a locking position, wherein in the locking position the locking element locks the damper in an at least partially linearly compressed damping position, and wherein in the release position the damper is free to move linearly relative to the locking element, the locking element including an actuator receiving portion; and an operating element rotatably received in the receiving opening of the support, the operating element including an eccentric actuator received in the actuator receiving portion of the locking element, such that upon rotation of the operating element relative to the support and the locking element interaction of the eccentric actuator of the operating element and the actuator receiving portion of the locking element moves the locking element between the release position and the locking position.

15. The furniture hinge of claim 14, wherein:

the operating element includes a base part and a top part, the top part including a tool receiving portion.

16. The furniture hinge of claim 14, wherein:

the operating element is rotatable relative to the support between at least two latching positions.

17. The furniture hinge of claim 14, wherein:

the support includes a base part including at least one positioning member; and the operating element includes at least one positioning element, the at least one positioning member and the at least one positioning element being resilient with respect to one another to form at least one latching position when the at least one positioning element engages the at least one positioning member.

18. The furniture hinge of claim 14, wherein:

the operating element includes at least one latching element; and the support includes at least one counter latching element which interacts with the at least one latching element to form at least one latching connection.

19. The furniture hinge of claim 14, wherein:

the support includes two retaining lugs defining a receiving region between the two retaining lugs, the receiving region forming the linear guide for the locking element.

20. The furniture hinge of claim 14, wherein:

the damper includes a detent member; and the locking element includes a bolt configured to rest against the detent member in the locking position of the locking element so as to form an interlocking connection in a damping direction such that at least one of the bolt and the detent member are resiliently retained.

* * * * *